US005216194A

United States Patent [19]

Boire

[11] Patent Number: 5,216,194

[45] Date of Patent: Jun. 1, 1993

[54] LIGHTWEIGHT MOLDED CARTRIDGE CASE AND NOZZLE ASSEMBLY FOR RECOILLESS LAUNCH SYSTEMS

[75] Inventor: William A. J. Boire, Victoria, Minn.

[73] Assignee: Alliant Techsystems Inc., Minneapolis, Minn.

[21] Appl. No.: 700,582

[22] Filed: May 15, 1991

[51] Int. Cl.[5] ..... F41A 1/08; F42B 5/05

[52] U.S. Cl. ..... 89/1.706; 102/376; 102/437; 102/469

[58] Field of Search ..... 102/430, 437, 464–472, 102/331, 376; 89/1.7–1.706, 1.806

[56] References Cited

U.S. PATENT DOCUMENTS

| | | | |
|---|---|---|---|
| 2,791,961 | 5/1957 | Musser | 102/437 |
| 3,609,904 | 10/1971 | Scanlon | 102/466 |
| 3,738,219 | 6/1973 | Fibres | 102/437 |
| 3,771,417 | 11/1973 | Schnabele et al. | 102/437 |

FOREIGN PATENT DOCUMENTS

| | | | |
|---|---|---|---|
| 1941897 | 3/1971 | Fed. Rep. of Germany | 89/1.706 |
| 1605300 | 8/1974 | France | 89/1.7 |
| 1187827 | 4/1970 | United Kingdom | 102/437 |

OTHER PUBLICATIONS

Exhibit "A" is a photograph of a perspective view of a disassembled two-piece aluminum cartridge case.

Exhibit "B" is a photograph of a side elevational view of a disassembled two-piece aluminum cartridge case.

*Primary Examiner*—Harold J. Tudor

*Attorney, Agent, or Firm*—Merchant, Gould, Smith, Edell, Welter & Schmidt

[57] ABSTRACT

A cartridge case and nozzle assembly is made from a single element of a lightweight durable polymer resin. The cartridge case and nozzle insert into a launch tube of an anti-armor projectile launcher and have improved adhesive connection to reduce relative movement between the assembly and the launch tube. Improved tolerances and better matching of the assembly and the launch tube provide improved reliability for firing. The adhesive connection prevents the launch tube from being reused by adversaries.

12 Claims, 2 Drawing Sheets

LIGHTWEIGHT MOLDED CARTRIDGE CASE AND NOZZLE ASSEMBLY FOR RECOILLESS LAUNCH SYSTEMS

BACKGROUND OF THE INVENTION

1. Field of the Invention

The present invention relates to an anti-armor weapon and in particular to an integral cartridge case and venturi nozzle for the launcher.

2. Description of the Prior Art

Man-portable launchers capable of being fired from the shoulder are well known. It is also desirable to have the weapon be as durable as possible, as the battleground provides a hostile environment capable of damaging the weapon.

Shoulder-fired weapons have a launch tube with a cartridge case holding the projectile. The cartridge case attaches to a venturi-type nozzle which extends out the rear of the launch tube for creating an even distribution of exhaust from the propellant used to launch the projectile. Heretofore, the cartridge case and the nozzle have been separate pieces constructed of an alloy, typically an aluminum alloy. The cartridge case and the nozzle were connected with an O-ring fitting into a groove in each piece.

The two piece construction has several shortcomings which may affect the performance of the weapon. Weight is critical as the weapon may be carried for extended periods of time and for extended distances, limiting mobility of the soldier and adding strain and fatigue. Although aluminum is a relatively lightweight metal, any weight saved is critical and a material lighter than aluminum with comparable strength characteristics improves the utility and performance of the weapon.

Shoulder fired weapons typically receive very rough treatment and the aluminum construction of the nozzle leads to nicks and bending of the venturi portion should the venturi portion be impacted from being thrown or dropped or hit by debris. The venturi nozzle's function is to direct and dissipate the propellant gases in a pattern that protects the operator and minimizes the "kick" of the weapon so that it is recoilless. Should the shape of the nozzle to be altered, as may occur if the end of the nozzle portion is impacted, the flow pattern of the exhaust gases may be affected so that the launcher is not necessarily recoilless.

The aluminum cartridge case has heretofore been secured to the launch tube with screws placed around the periphery of the launch tube. The absorption of energy due to the firing of the projectile places stresses on the bolts which can cause very high localized stress to the launch tube. In addition, the bolts may be remove and the cartridge case removed so that the launch tube may be reused. It is not desirable to have the launch tube be reused as the tube may be used by terrorists or enemy forces who recover the tubes left on battlefield.

The projectile is held in the cartridge case by a ring of adhesive. The projectile and launcher are designed so that the projectile releases from the launcher when the shear force at the adhesive joint reaches a predetermined level. This shear force is generated by the system's propellant. However, when firing, the aluminum expands so that the adhesive layer undergoes a peeling force which may exceed the predetermined release level of the adhesive. When this occurs, the projectile releases at the wrong instant and the performance and the reaction of the launcher may be affected. The swelling of the metal cartridge case, known as "slap", also affects the recoilless reaction, so that the launcher may recoil unexpectedly upon launching the projectile. With the metal cartridge it is difficult to improve the tolerances to match the launch tube and difficult to dissipate heat so that the cartridge case does not undergo thermal expansion.

It can be seen then that a man-portable launcher is needed which is rugged and lightweight, and has a cartridge case which minimizes weight, decreases slap, improves reliability and performance and is inexpensive to manufacture.

SUMMARY OF THE INVENTION

The present invention is directed to an integral cartridge case and nozzle for a recoilless launcher.

The launcher has a launch tube and an integral cartridge case and nozzle assembly which is molded from a single piece. The single piece construction of plastic resin material reduces weight and manufacturing cost and adds durability and reliability. The cartridge case and nozzle assembly is molded from a thermoplastic or thermoset resin material which is either molded, cast or machined. The resin material is lighter weight than comparable lightweight metal alloys and does not bend or crack as easily as lightweight metal alloy materials. In addition, with these materials, case and nozzle assemblies can be manufactured with tolerances that reduce "slap".

The integral cartridge case and nozzle assembly inserts in the rear of the launch tube and rests against the interior surface of the launch tube. The exterior of the cartridge case portion includes adhesive applied over virtually the entire surface area of the exterior of the cartridge case portion for increased contact area. The contact area provides for greater reliability as there is a minimum of relative movement between the launch tube and the cartridge case.

The cartridge case portion extends directly into the nozzle portion which creates a venturi effect to provide for even gas flow from the propellant upon firing. Since the resin materials do not deform under the hostile environment of the battle field, the propellant gas does not have an uneven pattern, thereby increasing reliability.

The single piece construction does not require an O-ring or any kind of connecting means between the previously-used two piece assemblies, thereby decreasing manufacturing costs. The thickness of the cartridge case and nozzle assembly can be minimized with adequate strength so that a significant weight savings is accomplished by using the molded resin single piece. Savings on the order of ¾ pound per nozzle and cartridge case assembly can be realized. Even minor weight savings significantly ease the burden for carrying and transporting the weapon by a single soldier.

The manufacturing techniques and material used give improved tolerances so that the recoilless firing is not affected by relative movement of launcher elements. In addition, the material of the cartridge case and nozzle assembly being in intimate contact with the launch tube will not experience the adhesive peeling stress as does the current multiple piece metal assembly. Only the shear stress affects the release of the projectile so that reliability is increased as the projectile fires at the correct instant.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference numerals and letters indicate corresponding elements throughout the several views.

DETAILED DESCRIPTION OF THE PREFERRED EMBODIMENT(S)

Figure 1:
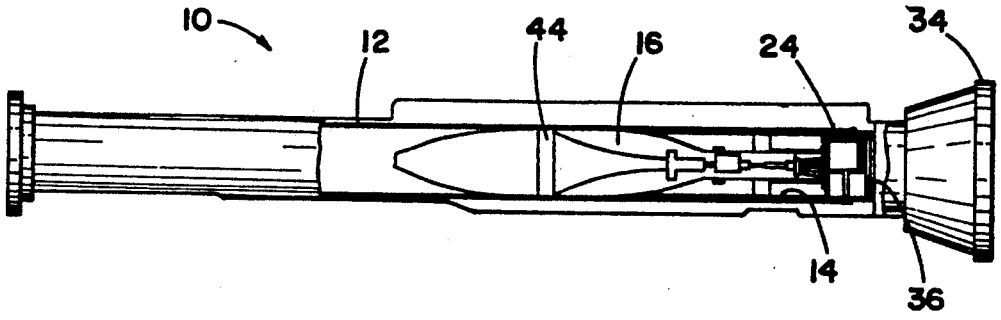
FIG. 1 shows a side sectional view of an anti-armor projectile launching system loaded with a projectile according to the principles of the present invention.
Figure 2:
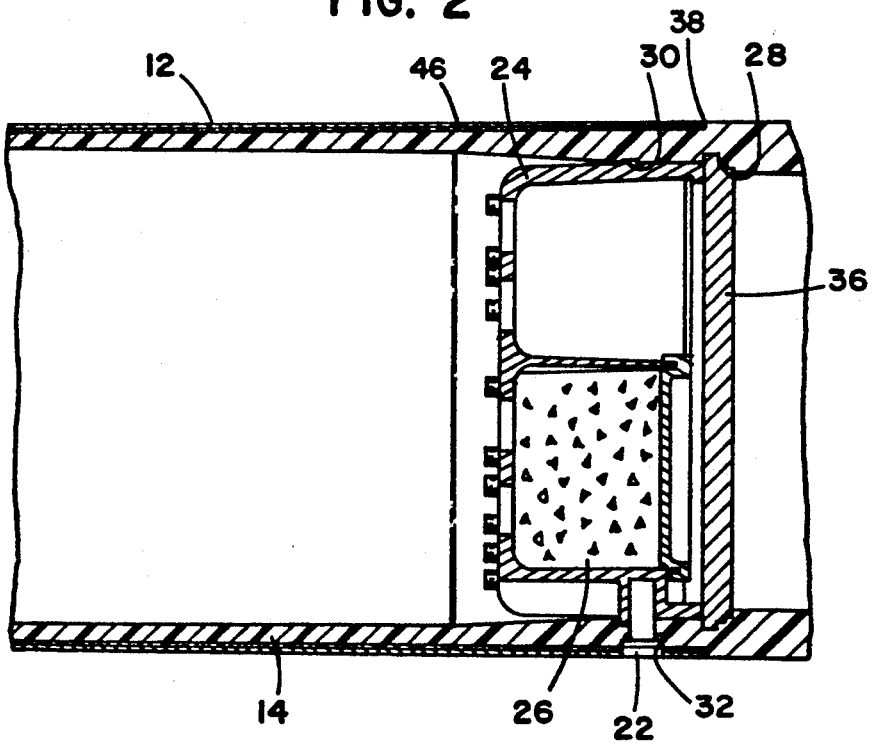
FIG. 2 shows a side sectional view of a portion of the firing mechanism and a portion of the launch tube and the cartridge case and nozzle assembly of the launching system shown in FIG. 1; and, FIG. 3 shows a side sectional view of an integral cartridge case and nozzle assembly for the launching system shown in FIG. 1.
Figure 3:
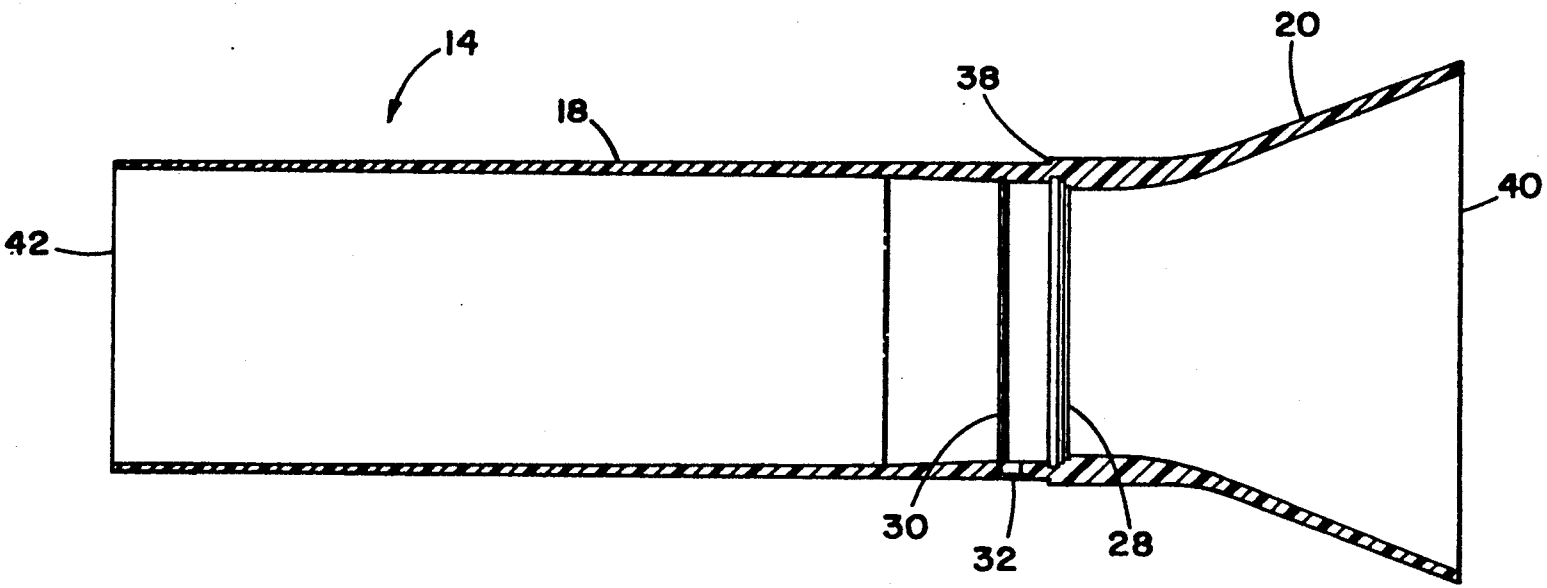

Referring now to the drawings, and in particular to FIG. 1, there is shown a portable launcher 10 firing an anti-armor projectile 16. The launcher 10 can be carried by a single soldier and is fired from the shoulder. The launcher 10 includes a filament wound epoxy/metal launch tube 12, a cartridge case and nozzle assembly 14 and a burst disk 36, which insert into the launch tube 12. As shown in FIG. 3, the cartridge case and nozzle assembly 14 has a cylindrical cartridge case portion 18 integral with a flared venturi portion 20 and a burst disk 36 fitting therein as shown in FIG. 2. The launcher 10 is recoilless so that the weapon does not "kick" when fired. The projectile 16 attaches to the cartridge case portion 18 of the cartridge case and nozzle assembly 14 with a ring of adhesive 44, as shown in FIG. 1. The adhesive 44 releases the projectile 16 upon firing when the shear stress reaches a predetermined level whereupon the burst disk 36 ruptures and the projectile 16 releases.

Referring to FIG. 2, a percussion cap 24 holds igniter material 26 adjacent to a detonator pin 22 extending through a hole 32 in the cartridge case 18. The igniter material 26 ignites the propellant in the cartridge case portion 18 in a uniform burn pattern so that the projectile 16 and the burst disk 36 function at the correct time. When the projectile 16 fires, the force against the percussion cap 24 pushes the burst disk 36 backward into the flared venturi portion 20 of the cartridge case and nozzle assembly 14. The burst disk 36 absorbs much of the shock so that the launcher 10 has recoilless firing. The percussion cap 24 is held in the cartridge case portion 18 by groove 30 while the burst disk 36 is held by grooves 28. The burst disk 36 hits a cap 34 at a flared end 40 of the venturi portion 20.

As shown in FIG. 3, the thickness of the walls of the cartridge case portion 18 taper from the rear to a front end 42 for weight savings. As shown in FIG. 2, the rear of the launch tube 12 fits over a portion of the cartridge case portion 18 and rests against a shoulder 38. The tolerances are very tight for the cartridge case portion 18, typically the tolerances for the outside diameter are plus or minus 0.002 inches in the preferred embodiment. The outside diameter of the cartridge case portion tapers from a nominal diameter of 3.483 inches adjacent the shoulder 38 to 3.380 inches at the front end 42. However, these dimensions will differ for different weapons. The taper facilitates sliding the cartridge case 18 into the launch tube 12. The taper of the exterior of the cartridge case 18 corresponds to the taper of the inside of the launch tube 12. Therefore, when the projectile 16 is fired, there is little to no relative motion between the cartridge case portion 18 and the launch tube 12, known as "slap", so that the recoilless characteristics are not changed. Adhesive 46 is applied to virtually the entire surface of the exterior of the cartridge case portion 18. The adhesive connection 46 between the outer surface of the cartridge case portion 18 and the inner surface of the launch tube 12 covers virtually 100% of the outer surface of the cartridge case portion 18, thereby minimizing slap as there is a large surface contact area. The surface-to-surface connection also dissipates heat and energy and reduces thermal expansion from heat of firing. Therefore, the cartridge case portion 18 does not expand, so that the shear stress on the adhesive ring 44 between the projectile 16 and the cartridge case portion 18 is not affected by any peeling stress from the cartridge case expanding, thereby increasing reliability.

As shown in FIG. 3, the cartridge case and nozzle assembly 14 is made from an integral piece. No O-rings or other type of connector is needed between the venturi portion 20 and the cartridge case portion 18. In the preferred embodiment, the cartridge case and nozzle assembly material is a polymer material of a thermoplastic or thermoset resin composition. It is critical that the material be chemically inert with the propellant of the projectile 16. The material must also be very durable and lightweight. Durability is critical in battlefield conditions as the weapon is often dropped or thrown away or may be struck by flying debris. The thermoplastic resin composition allows for easy method of manufacture which can easily fall within the desired tolerances. In the preferred embodiment, thermoset compositions which may be used include thermoset polyesters, cured epoxy resins or alkyds. Thermoplastics which may be used include nylon, thermoplastic polyesters, polyamides, thermoplastic liquid crystal polymers, polycarbonates, polysulphones, polyethersulphones, polyetherimides, or polyetherketones. The resins are filled with reinforcing materials which may include chopped strands of glass, aramid, carbon fibers or any combination of suitable fibers.

The cartridge case and nozzle assembly 14 may also be cast using resin materials including epoxies, polyurethanes, or other single or multi-part resins. The types of suitable materials and tolerances required provide for a number of manufacturing methods including injection molding, compression molding, hand or machine filament winding, single or multi-part cast systems, bulk molding compounds, or machining from a solid material or matrix. With these manufacturing methods, durable materials which are lightweight and inexpensive to manufacture are obtained. The resin materials provide for weight savings of over ¾ of a pound in the cartridge case and nozzle assembly 14 as compared to the prior aluminum two-part assemblies. In addition, the resin materials are not prone to cracking and do not become bent when impacted. Since the venturi portion 20 which directs gas flow in a uniform manner may become bent when made of aluminum, use of the durable resin compounds which are not prone to bending prevents the exhaust from being distributed in a non-uniform manner which could lead to uneven firing.

In addition, the cartridge case and nozzle assembly 14 easily inserts into the launch tube 12 and provides for a large surface area of attachment, thereby reducing the chance of failure from bolts or screws giving way. Furthermore, the cartridge case and nozzle 14 may not be removed from the launch tube 12 without ruining the launch tube 12, thereby rendering the launch tube 12 unusable for a second firing. This characteristic is desirable as the enemy or terrorist groups may acquire the spent tube and refurbish it.

The present invention provides for a very durable single piece nozzle and cartridge assembly 14 which tolerances. In addition, the weapon is less likely to be damaged during battle and is easier to use due to weight savings. Manufacturing costs are reduced by using a single piece and reliability is increased from the closer tolerances and improved connection methods.

It is to be understood, however, that even though numerous characteristics and advantages of the present invention have been set forth in the foregoing description, together with details of the structure and function of the invention, the disclosure is illustrative only, and changes and arrangement of parts within the principles of the invention to the full extent indicated by the broad general meaning of the terms in which the appended claims are expressed.

What is claimed is:

1. An integral cartridge case and nozzle device attaching to an interior surface of a launch tube of a portable launcher and receiving a projectile, comprising a cylindrical cartridge case portion proximate a venturi portion flaring out from the cartridge case portion, wherein an exterior surface of the cartridge case portion has a diameter slightly smaller than a diameter of the launch tube interior surface, and wherein the exterior surface of the cartridge case and nozzle device includes an adhesive for adhesively attaching to the interior surface of the launch tube, wherein adhesive is applied to virtually the entire exterior surface of the cylindrical cartridge case portion.

2. A cartridge case and nozzle device according to claim 1, wherein the cartridge case and nozzle device further comprises a burst disk receiving portion.

3. A cartridge case and nozzle device according to claim 1, wherein the cartridge case and nozzle device is comprised of a lightweight molded polymer resin.

4. A cartridge case and nozzle device according to claim 1, wherein the integral cartridge case and nozzle comprises a polymeric material chemically inert to propellant for the projectile.

5. A recoilless projectile launcher device having a launch tube, a cartridge case and nozzle, the cartridge case and nozzle inserting into a first end of the launch tube, wherein the cartridge case and nozzle are integrally molded and wherein the launch tube has an interior surface with a portion proximate the first end tapering from the first end, and wherein the cartridge case has an exterior surface tapering from the nozzle portion so that the taper of the exterior of the cartridge case complements the taper of the interior of the launch tube whereby the exterior surface of the cartridge case is non-extractably secured with adhesive to the interior surface of the launch tube.

6. A launcher device according to claim 5, wherein the cartridge case and nozzle are comprised of a polymer resin selected from the group consisting of thermoset polyesters, cured epoxy resins, alkyds, thermoplastics including nylon, thermoplastic polyesters, polyamides, thermoplastic liquid crystal polymers, polycarbonates, polysulphones, polyethersulphones, polyetherimides, polyetherketones, and polyurethanes.

7. A launcher device according to claim 5, wherein the cartridge case and nozzle is molded from a thermoplastic resin.

8. A launcher device according to claim 5, wherein the cartridge case and nozzle is chemically inert with the propellant of the projectile.

9. A launcher device according to claim 5, wherein the cartridge case has tolerances for exterior diameter of plus or minus 0.002 inches.

10. A launcher device according to claim 5, wherein the cartridge case and nozzle further comprise an exterior shoulder engaging an end of the launch tube.

11. A launcher device according to claim 5, wherein walls of the cartridge case narrow as the outside diameter tapers.

12. An integral cartridge case and nozzle device adapted for attaching the interior of a launch tube of a portable launcher and receiving a projectile, comprising a cylindrical cartridge case portion proximate a venturi portion flaring out from the cylindrical cartridge case portion, wherein adhesive is applied to virtually the entire exterior surface of the cylindrical cartridge case portion.

* * * * *

UNITED STATES PATENT AND TRADEMARK OFFICE

CERTIFICATE OF CORRECTION

PATENT NO. : 5,216,194

DATED : June 1, 1993

INVENTOR(S) : W. Boire

It is certified that error appears in the above-identified patent and that said Letters Patent is hereby corrected as shown below:

Column 1, Line 54, DELETE "remove" and INSERT therefor --removed--

Column 1, Line 58, INSERT --the-- after "on"

Column 5, Line 18, INSERT --increases reliability due to improved connections and-- after "which"

Column 5, Line 30, INSERT --may be made in detail, especially in matters of shape, size-- after "changes"

Signed and Sealed this

Twenty-second Day of March, 1994

Bruce Lehman

*Attest:*

BRUCE LEHMAN

*Attesting Officer*

*Commissioner of Patents and Trademarks*